US009108313B2

(12) United States Patent
Gonzalez

(10) Patent No.: US 9,108,313 B2
(45) Date of Patent: Aug. 18, 2015

(54) MULTI-FUNCTION TOOL

(71) Applicant: Anthony Gonzalez, Lake Ronkonkoma, NY (US)

(72) Inventor: Anthony Gonzalez, Lake Ronkonkoma, NY (US)

( * ) Notice: Subject to any disclaimer, the term of this patent is extended or adjusted under 35 U.S.C. 154(b) by 230 days.

(21) Appl. No.: 13/896,364

(22) Filed: May 17, 2013

(65) Prior Publication Data

US 2014/0338133 A1 Nov. 20, 2014

(51) Int. Cl.
*B25F 1/00* (2006.01)
*F42B 33/06* (2006.01)
*F42B 3/26* (2006.01)

(52) U.S. Cl.
CPC . *B25F 1/003* (2013.01); *F42B 3/26* (2013.01); *F42B 33/06* (2013.01)

(58) Field of Classification Search
CPC ..... B25F 1/003; F42B 33/06; F42B 3/26; B25B 7/22; H02G 1/1212
USPC ..... 7/128
See application file for complete search history.

(56) References Cited

U.S. PATENT DOCUMENTS

| | | | | | |
|---|---|---|---|---|---|
| 365,179 | A * | 6/1887 | Hale | 86/22 |
| 463,912 | A * | 11/1891 | McVitty | 86/22 |
| 610,305 | A * | 9/1898 | Mino et al. | 86/22 |
| 1,356,243 | A * | 10/1920 | Walker | 86/22 |
| 1,361,301 | A * | 12/1920 | Blackmore | 86/22 |
| 1,373,138 | A * | 3/1921 | Larrimore | 86/22 |
| 1,640,089 | A | 4/1926 | Murphy | |
| 1,619,181 | A * | 3/1927 | Beretz | 30/91.2 |
| 1,732,676 | A * | 10/1929 | Erbele | 86/21 |
| 2,930,277 | A * | 3/1960 | Jennerman | 86/22 |
| 3,831,207 | A * | 8/1974 | Boyajian | 7/107 |
| 4,091,483 | A * | 5/1978 | Lewis | 7/132 |
| 4,225,990 | A * | 10/1980 | Theiler, Sr. | 7/107 |
| 4,337,542 | A * | 7/1982 | Theiler, Sr. | 7/107 |
| 4,995,128 | A * | 2/1991 | Montgomery et al. | 7/127 |
| 5,323,502 | A * | 6/1994 | Miller | 7/107 |
| 5,894,617 | A * | 4/1999 | Liou | 7/107 |
| 6,081,952 | A * | 7/2000 | Haxton | 7/107 |
| 6,748,617 | B1 | 6/2004 | Toycen et al. | |
| 7,162,758 | B2 * | 1/2007 | Skinner | 7/127 |
| 7,587,963 | B1 * | 9/2009 | Broadus | 81/414 |
| 2006/0032345 | A1 * | 2/2006 | Crawley | 81/439 |

* cited by examiner

*Primary Examiner* — David B Thomas
(74) *Attorney, Agent, or Firm* — Leo G. Lenna; Sorell, Lenna & Schmidt LLP

(57) ABSTRACT

A multi-function hand tool is provided. The multi-function hand tool includes a first member and a second member pivotally connected to the first member such that the hand tool is pivotable between an open orientation and a closed orientation. The first member includes a first cutting element and a second cutting element disposed proximal to the first cutting element. The first cutting element has a first cutting blade and the second cutting element has a second cutting blade and a first at least one groove. The second member extends between a proximal end and a distal end. The distal end of the second member includes a third cutting element corresponding to the second cutting element. The third cutting element has a third cutting blade corresponding to the second cutting blade and at least one second groove corresponding to the first at least one groove.

20 Claims, 6 Drawing Sheets

MULTI-FUNCTION TOOL

TECHNICAL FIELD

The present disclosure generally relates to multi-function hand tools, and more particularly to multi-function hand tools used in Explosive Ordnance Disposal (EOD).

BACKGROUND

Blasting caps or detonators are used to induce the detonation of a larger and more powerful explosive, which for safety purposes is designed to detonate only after a certain threshold amount of energy is supplied. Fuses extend from the blasting caps and are designed to carry fire to the blasting caps to initiate ignition. Blasting caps are usually provided with a thin-walled outer metallic shell, into the end of which the fuse or bridge plug with lead wires is inserted. The shell wall is then crimped onto the plug or fuse to seal the shell. It is often difficult in obtaining a good seal in crimping articles of this kind. Pliers-type crimpers can be used to accomplish this task.

Pliers-type crimpers include a single pair of crimping elements, and may include other tool features, such as fuse/cord cutters and a powder punch on one of the handles. Present crimpers are relatively complex and bulky and are not as portable as desired. For safety, it is desirable that a crimper also be non-sparking and non-magnetic. Materials that have the desired properties, such as titanium and beryllium-copper, are relatively expensive, and titanium is difficult to machine. Although aluminum has the desired properties in terms of ease of manufacture and is also non-sparking and non-magnetic, aluminum by itself does not have the desired wear properties. For military use, additional features are required or desirable. Specifically, the crimper should be non-reflective and leave no magnetic signature for reduced detectability in the field.

When dealing with explosives, using multiple separate tools to carry out various functions is inconvenient, and more importantly, increases the danger of setting off a spark that could ignite the explosive being worked on. Therefore, it is desirable to have a tool that includes various functions that are often performed by separate individual tools. This disclosure describes a hand tool that is designed to effectively perform multiple functions that are usually performed with multiple separate tools. The disclosed hand tool, therefore, obviates the risk involved in taking out and putting away multiple tools in the vicinity of high-powered explosives.

SUMMARY

Accordingly, in one embodiment, in accordance with the principles of the present disclosure, a multi-function hand tool is provided. The multi-function hand tool includes a first member and a second member. The second member is pivotally connected to the first member such that the hand tool is pivotable between an open orientation and a closed orientation. In one embodiment in accordance with the principles of the present disclosure the hand tool is biased in the open position so that when released, the first and second members spread apart so that the tool is ready for the next use. In one embodiment in accordance with the principles of the present disclosure, the first member extends between a proximal end and a distal end. The distal end includes a first cutting element and a second cutting element disposed proximal to the first cutting element. The first cutting element has a first cutting blade and the second cutting element has a second cutting blade and a first at least one groove. The second member extends between a proximal end and a distal end. The distal end of the second member includes a third cutting element corresponding to the second cutting element. The third cutting element has a third cutting blade corresponding to the second cutting blade and a second at least one groove corresponding to the first at least one groove. In the closed orientation the first and second at least one grooves form at least one of a wire stripper and a crimper. The proximal end of one of the first and second members includes a longitudinal member having a tapered distal tip.

In one embodiment, in accordance with the principles of the present disclosure, a system is provided. The system includes the multi-function hand tool recited above and a holder for holding the multi-function hand tool. The system may also include additional replacement blades and/or punches.

In one embodiment, in accordance with the principles of the present disclosure, a multi-function hand tool is provided. The multi-function hand tool includes a first member and a second member. The second member is pivotally connected to the first member such that the hand tool is pivotable between an open orientation and a closed orientation. The first member extends between a first handle portion and a first jaw. The first jaw includes a first cutting element and a second cutting element disposed proximal to the first cutting element. The first cutting element has a first cutting blade and the second cutting element has a second cutting blade, a first semicircular groove and a first sinusoidal groove. Additional configurations are also within the scope of the present disclosure. The first sinusoidal groove is proximal to the first semicircular groove. The second member extends between a second handle portion and a second jaw. The second jaw includes a third cutting element corresponding to the second cutting element. The third cutting element has a third cutting blade corresponding to the second cutting blade. The third cutting element has a second semicircular groove corresponding to the first semicircular groove and a second sinusoidal groove corresponding to the first sinusoidal groove. The first and second semicircular grooves each include a beveled edge. In the closed orientation the first and second semicircular grooves form a wire stripper and the first and second sinusoidal grooves form a crimper. The handle portion of one of the first and second members includes a powder punch.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
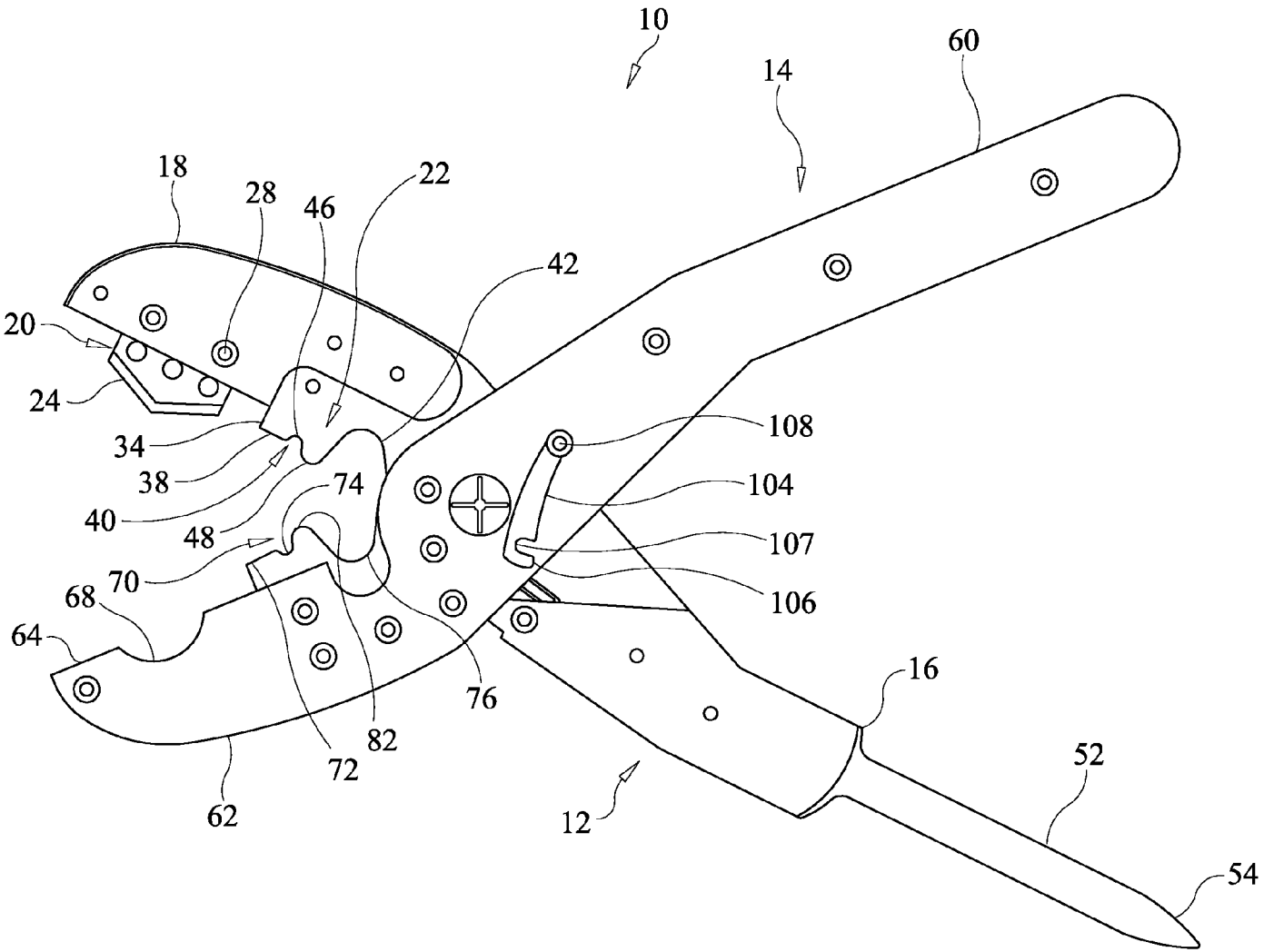
FIG. 1 is a plan view of one embodiment of a multi-function hand tool in an open orientation in accordance with the principles of the present disclosure.

The exemplary embodiments of the system and related methods of use disclosed are discussed in terms of multi-function hand tools, and more particularly, in terms of a multi-function hand tool designed for the Explosive Ordnance Disposal (EOD), Bomb Squad, Improvised Explosive Device (IED), Military and law enforcement sectors.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a system in accordance with the principles of the present disclosure. Alternate embodiments are also disclosed. Reference will now be made in detail to the exemplary embodiments of the present disclosure, which are illustrated in the accompanying figures. Turning now to FIGS. 1-4, there is illustrated components of a tool, such as, for example, a multi-function hand tool 10 in accordance with the principles of the present disclosure.

The components of tool 10 can be fabricated from metals, synthetic polymers, and ceramics. The components of tool 10 are constructed from, or at least coated with, materials that are non-magnetic, non-sparking, chemically inert, light-weight, non-conductive and do not hold and/or dispense a static discharge. For example, the components of tool 10 can be constructed from and/or coated with G-10 high pressure composite glass laminate or other materials known in the art as possessing the above recited properties. The components of tool 10, individually or collectively, may also be fabricated from materials such as stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics and composites thereof such as calcium phosphate (e.g., SKELITE™ manufactured by Biologix Inc.), thermoplastics such as polyaryletherketone (PAEK) including polyetheretherketone (PEEK), polyetherketoneketone (PEKK) and polyetherketone (PEK), carbon-PEEK composites, PEEK-BaSO4 polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, epoxy. Various components of tool 10 may have material composites, including the above materials, to achieve various desired characteristics such as strength, rigidity, elasticity, compliance, and durability. The components of tool 10, individually or collectively, may also be fabricated from a heterogeneous material such as a combination of two or more of the above-described materials. Any of the above-mentioned materials can be coated with a static resistant material so as to eliminate any static build up and discharge. Coating materials provides a way to achieve the strength of some of the above-mentioned materials while still being static resistant. The components of tool 10 may be monolithically formed, integrally connected or include fastening elements and/or instruments, as described herein.

Tool 10 includes a first member 12 and a second member 14, which are similar to two arms of a pair of pliers. It is contemplated that the cross section and/or overall configuration of first and second members 12, 14 may be variously configured, such as, for example, round, oval, oblong, square, rectangular, polygonal, irregular, uniform, non-uniform, offset, staggered, tapered, consistent or variable, depending on the requirements of a particular application. It is further contemplated that first and second members 12, 14 may include an outer gripping surface configured for gripping by a hand of a user. It is envisioned that the gripping surface may be, such as, for example, rough, arcuate, undulating, mesh, porous, semi-porous, dimpled and/or textured according to the requirements of a particular application. Second member 14 is pivotally connected to first member 12 such that tool 10 is pivotable between an open orientation (FIG. 1) and a closed orientation (FIG. 2). In the closed orientation, tool 10 has an average width of approximately 1.5 to 2 inches, preferably approximately 1.70 inches, and a length of approximately 7-9 inches, preferably approximately 8.125 inches.

First member 12 extends between a proximal end, such as, for example, a handle portion 16 and a distal end, such as, for example, a first jaw 18. Jaw 18 includes a first cutting element 20 and a second cutting element 22 disposed proximal to the first cutting element 20. First cutting element 20 includes a first cutting blade 24 made of a non-sparking, non-magnetic material, such as, for example, high strength aircraft quality aluminum. In some embodiments, the first cutting blade 24 is made of various materials, such as, for example, those alternatives described herein. First cutting blade 24 has an anodized outer surface. First cutting blade 24 has a triangular profile configured to cut, for example, fuses used to convey fire to an explosive cap, such as, for example, blasting caps. In some embodiments, first cutting blade 24 is variously shaped, such as, for example, round, oval, oblong, square, triangular, rectangular, polygonal, irregular, uniform, non-uniform, offset, staggered, tapered, consistent or variable, depending on the requirements of a particular application. First cutting blade 24 includes a plurality of openings 26 configured for disposal of set screws 28. First cutting element 20 is disposed in a cavity 30 at distal end 18 of first member 12 and set screws 28 are disposed through at least two of openings 26 to secure first cutting element 20 to first member 12. If desirable, the amount that first cutting element 20 protrudes from first member 12 can be adjusted by inserting the first cutting element 20 into cavity 30 either at a first depth or a second depth that is greater than the first depth.

Figure 3:
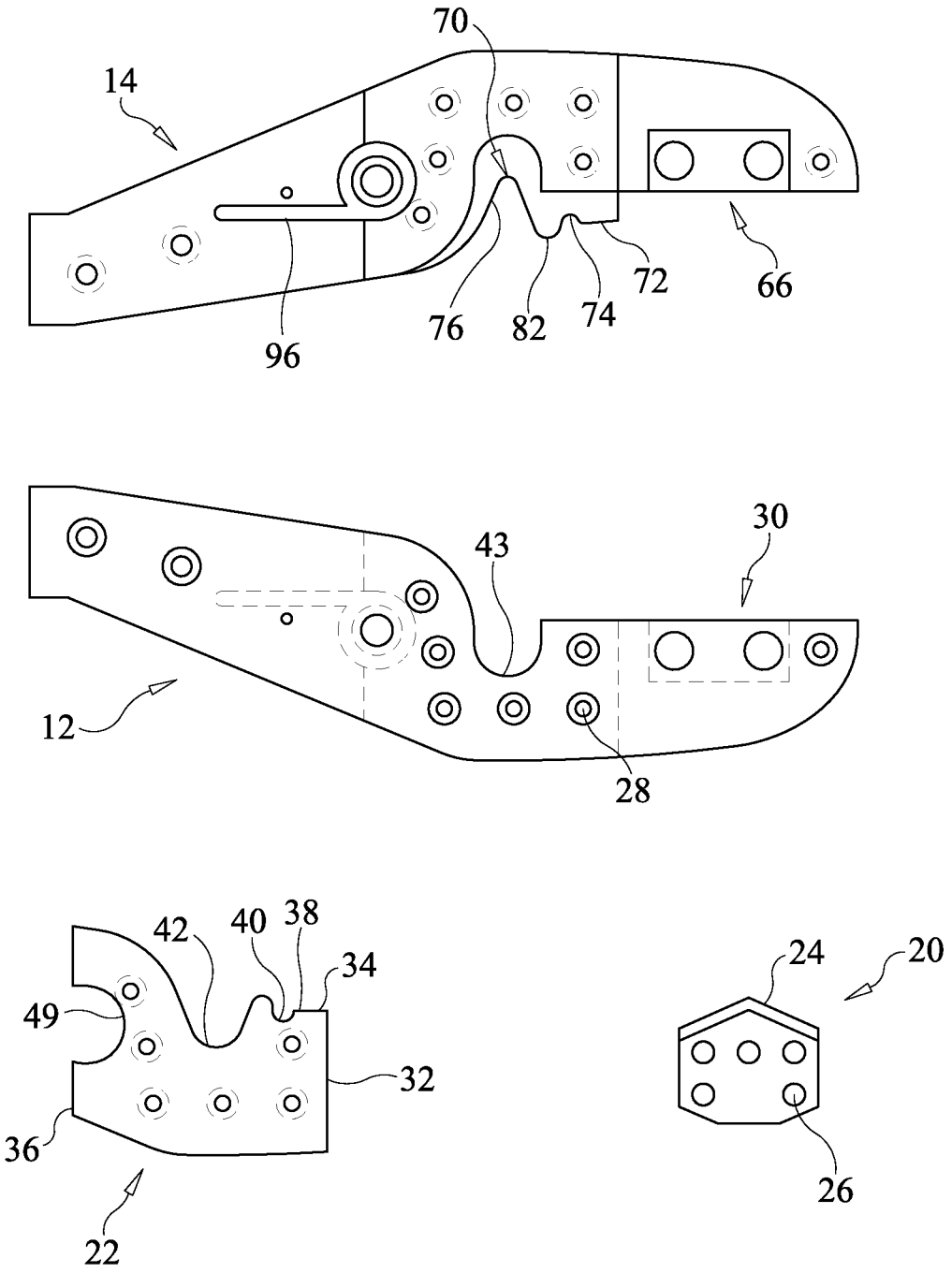
FIG. 3 is an exploded view, in part phantom, of components of the tool shown in FIG. 1.

The second cutting element 22 is disposed proximately adjacent to the first cutting element 20 so that first and second cutting elements 20, 22 are spaced apart along jaw 18. Second cutting element 22 is constructed of similar material as first cutting element 20 and also includes an anodized outer surface finish. Second cutting element 22 extends between a first end 32 and a second end 36 (FIG. 3). First end 32 includes a second cutting blade 34 having a substantially planar cutting surface 38. It is contemplated that cutting surface 38 is variously shaped, such as, for example, serrated, linear, straight, curved, convex, concave, continuous, intermittent, even, uneven and combinations thereof to facilitate cutting fuses and/or blasting caps.

Second cutting element 22 further includes a first pair of grooves, such as, for example, a first semicircular groove 40 and a first sinusoidal groove 42. First semicircular groove 40 is disposed proximally adjacent to second cutting blade 34 and first sinusoidal groove 42 is disposed proximally adjacent to first semicircular groove 40. It is contemplated that first semicircular groove 40 and first sinusoidal groove 42 are variously shaped, such as, for example, round, oval, oblong, square, triangular, rectangular, polygonal, irregular, uniform, non-uniform, offset, staggered, tapered, consistent or variable, depending on the requirements of a particular application. First semicircular groove 40 includes a beveled edge 46 configured for stripping wire fuses. Second cutting element 22 is connected to jaw 18 such that first sinusoidal groove 42 is positioned within an arcuately shaped recess 43 in jaw 18.

Second cutting element 22 includes a projection 48 disposed between first semicircular groove 40 and first sinusoidal groove 42. Projection 48 is configured for guiding a fuse or wire into first semicircular groove 40 or first sinusoidal groove 42. Second cutting element 22 further includes an arcuate shaped groove 49 at its second end 36 configured for disposal of a screw assembly and a biasing member, to be described below. A plurality of openings in second cutting element 22 are configured for disposal of set screws 28 for securing second cutting element 22 to first member 12.

Figure 2:
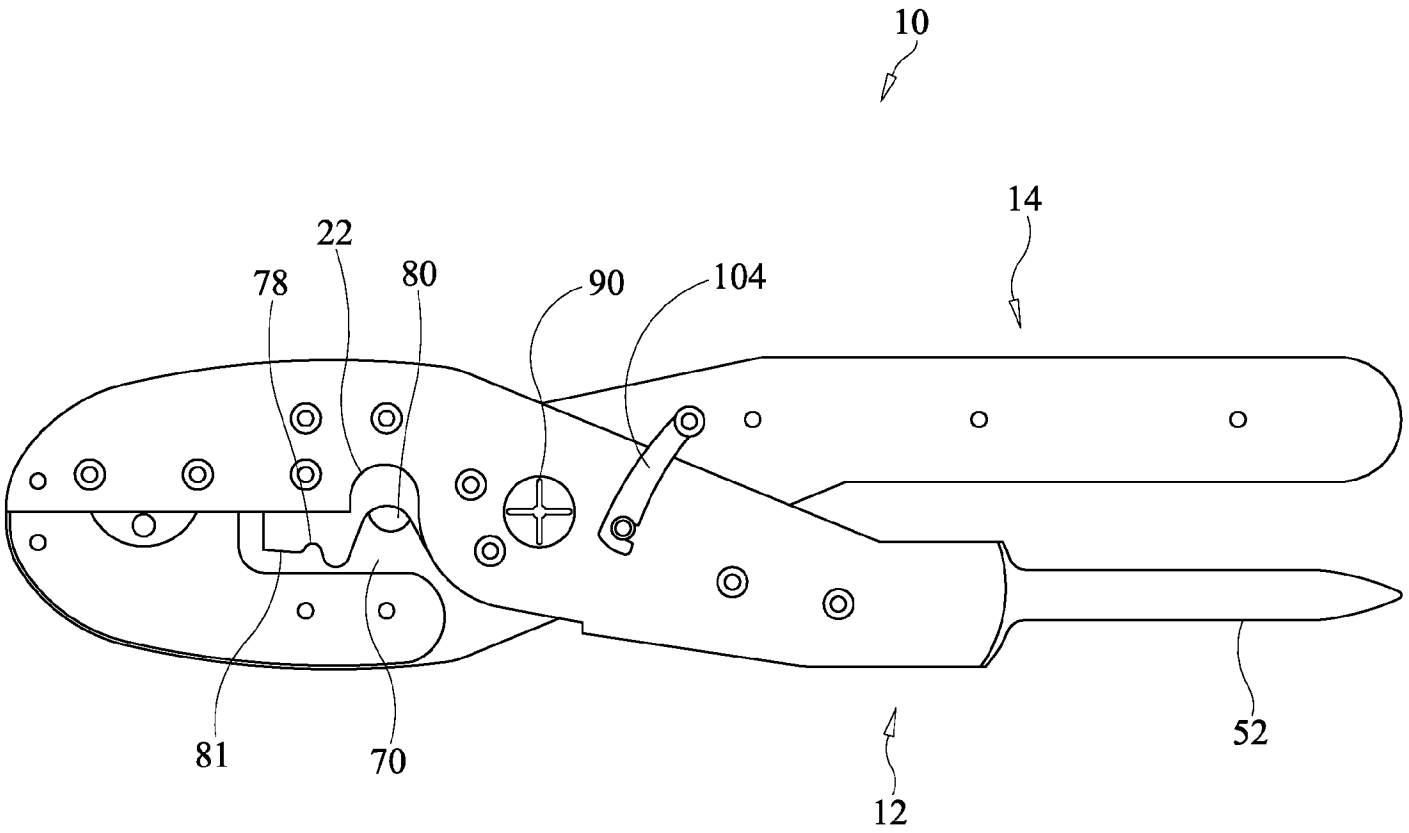
FIG. 2 is a plan view of the tool shown in FIG. 1 in a closed orientation.
Figure 4:
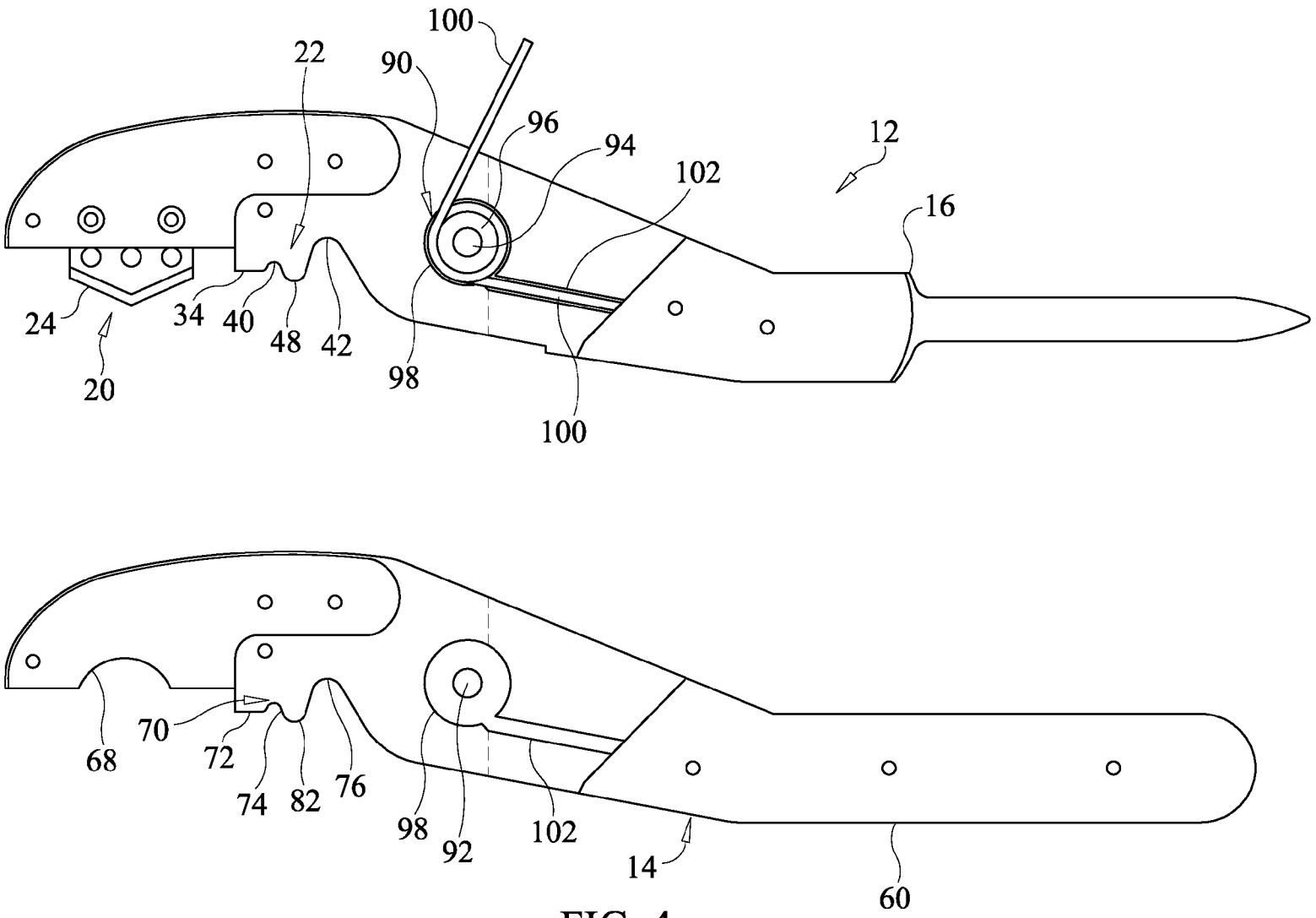
FIG. 4 is an exploded view of first and second members of the tool shown in FIG. 1.

As shown in FIGS. 1-2 and 4, handle portion 16 of first member 12 can include a longitudinal member, such as, for example, a powder punch or cartridge punch 52. Powder punch 52 has a tapered distal end 54 configured for punching an opening in an explosive to receive a detonator or a piece of a detonating cord. Powder punch 52 is constructed of a non-sparking, non-magnetic, non-conductive, chemically inert, lightweight and non-static charge holding or discharging material, such as, for example, G-10 high pressure glass laminate. In some embodiments, handle portion 16 of first member 12 is a handle without a powder punch 52 and powder punch 52 is instead disposed on second member 14. Powder punch 52 has a length of approximately 2-3 inches, preferably approximately 2.40 inches, and a diameter of approximately 0.25-0.5 inches, preferably approximately 0.3 inches.

Second member 14 extends between a proximal end, such as, for example, a handle portion 60 and a distal end, such as, for example, a second jaw 62. Jaw 62 includes an inner face 64 defining a receptacle 66 configured for disposal of first cutting element 20 in the closed orientation. Receptacle 66 has an arcuate cross section configuration. It is contemplated that receptacle 66 has variously shaped cross section configurations to accommodate first cutting element 20, such as, for example, oval, oblong, triangular, square, polygonal, irregular, uniform, non-uniform, offset, staggered, undulating, arcuate, variable and/or tapered. Inner face 64 further defines a semicircular notch 68.

Second member 14 includes a third cutting element 70, similar to second cutting element 22 described above with regard to first member 12, disposed within inner face 64 of jaw 62 and proximally adjacent to notch 68. At least a portion of second and third cutting elements 22, 70 are in overlapping contact. Third cutting element 70 corresponds to second cutting element 22 so as to matingly slide against second cutting element 22 during actuation of tool 10 between the open and closed orientations. Third cutting element 70 has a third cutting blade 72, similar to second cutting blade 34 described above, that corresponds to second cutting blade 34 so as to matingly slide against second cutting blade 34 during actuation of tool 10 between the open and closed orientations. Second and third cutting blades 34, 72 form cutters 81 for cutting, for example, fuses and/or blasting caps.

Third cutting element 70 includes a second semicircular groove 74, similar to first semicircular groove 40 described above, that corresponds to first semicircular groove 40. Second semicircular groove 74 is disposed proximally adjacent to second cutting blade 34. Third cutting element 70 further includes a second sinusoidal groove 76, similar to first sinusoidal groove 42 described above, that corresponds to first sinusoidal groove 42. Second sinusoidal groove 76 is disposed proximally adjacent to second semicircular groove 74. In the closed orientation, first and second semicircular grooves 40, 74 form a wire stripper 78 (FIG. 2) and first and second sinusoidal grooves 42, 76 form a crimper 80 (FIG. 2) for crimping a blasting cap to a fuse. Third cutting element 70 includes a projection 82, similar to projection 48 described above, disposed between second semicircular groove 74 and second sinusoidal groove 76. Projections 48, 82 of second and third cutting elements 22, 70, respectively, work together to capture, for example, a wire or fuse in crimper 80.

First and second members 12, 14 are pivotally connected to one another via a screw assembly 90 (FIG. 4). Screw assembly 90 extends through a thickness of first and second members 12, 14 at a substantially central location along the lengths of first and second members 12, 14. Screw assembly 90 is further disposed within arcuate shaped grooves 49 of second and third cutting elements 22, 70. At least a portion of second and third cutting elements 22, 70 are in overlapping contact so that second and third cutting elements 22, 70 are rotatable relative to one another and around screw assembly 90. Screw assembly 90 includes a screw 92 threadedly engaged to a hollow screw 94 such that first and second members 12, 14 remain rotatable with respect to one another. It is contemplated that the first and second members 12, 14 are connected by various means, such as, for example, a nut and bolt, post or pin.

Tool 10 further includes an internal biasing member, such as, for example, a coil spring 96 that resiliently biases tool 10 in the open orientation. It is contemplated that biasing member can be variously configured, such as, for example, an elastomeric member, clip, or leaf spring. Spring 96 is disposed within circular passageways 98 of first and second members 12, 14 and wrapped about screw assembly 90. Spring 96 includes two arms 100 disposed within channels 102 of first and second members 12, 14. Channels 102 each extend proximally from respective passageways 98 of first and second members 12, 14. Each arm 100 of spring 96 exerts an inward biasing force on proximal ends 16, 60 of first and second members so as to resiliently bias tool 10 in the closed orientation.

Tool 10 further includes a locking mechanism, such as, for example, a latch lock 104 centrally disposed on an outer surface of tool 10. Latch lock 104 can detachably lock tool 10 in the closed orientation by rotating a latch 106 into engagement with a pin 108 disposed on one of the first member 12 or second member 14. Latch 106 includes a notch 107 at its distal end configured for detachable engagement with pin 108. It is contemplated that tool 10 can be detachably locked in the open and/or closed orientation by various locking mechanisms, such as, for example, pin, post, screw, living hinge, ratchet and/or concentric parts.

Figure 5:
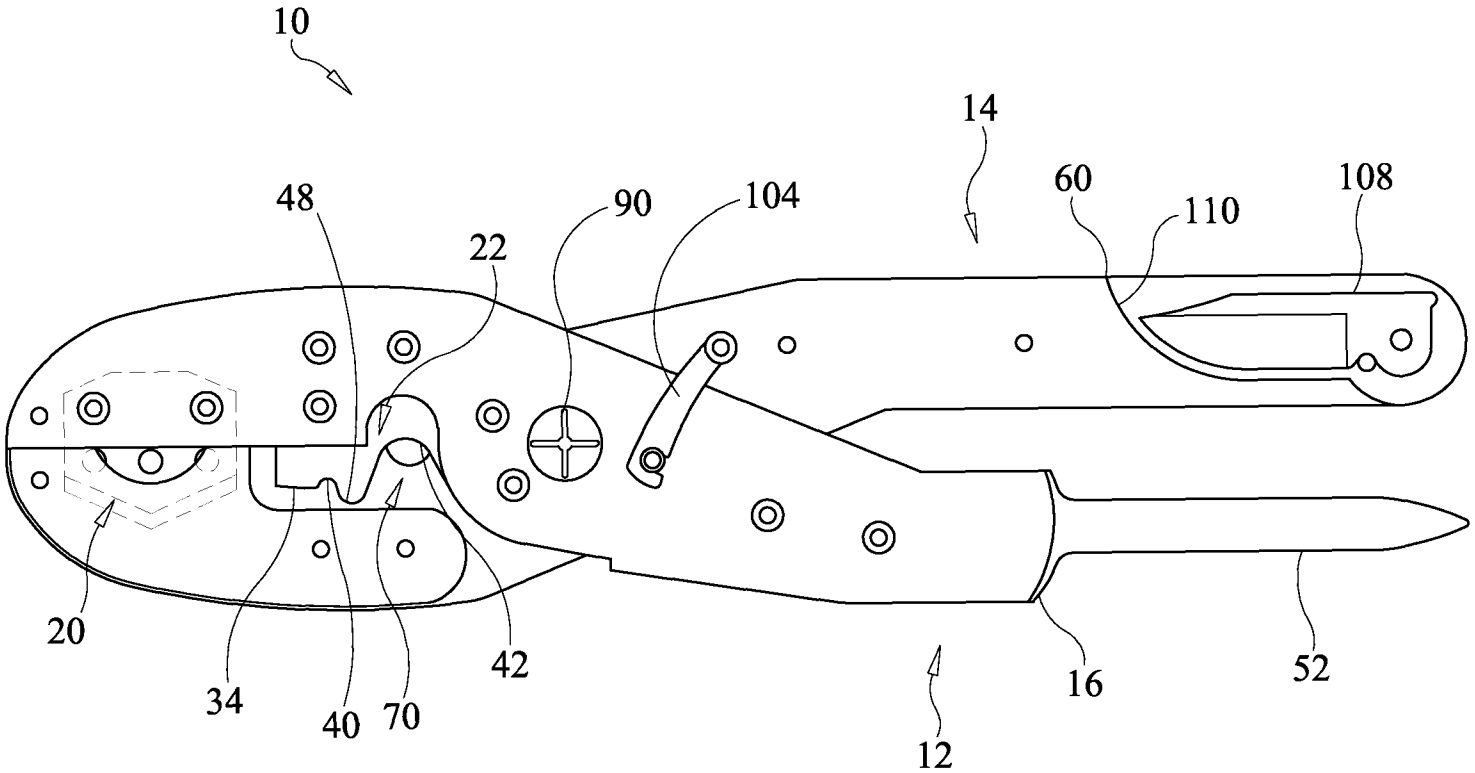
FIG. 5 is a plan view, in part phantom, of one embodiment of a multi-function hand tool in a closed orientation in accordance with the principles of the present disclosure.

In one embodiment, as shown in FIG. 5, tool 10, similar to that described above with regard to FIGS. 1-4, includes a folding blade 108 pivotally connected to a proximal end (16 or 60) of one of the first and second members 12, 14. In the illustrated embodiment, for example, folding blade 108 is pivotally connected to proximal end 60 of second member 14. Proximal end 60 includes a cutout portion 110 configured for disposal of folding blade 108.

Folding blade 108 has a length of approximately 1.5-2 inches, preferably approximately 1.65 inches.

Figure 6:
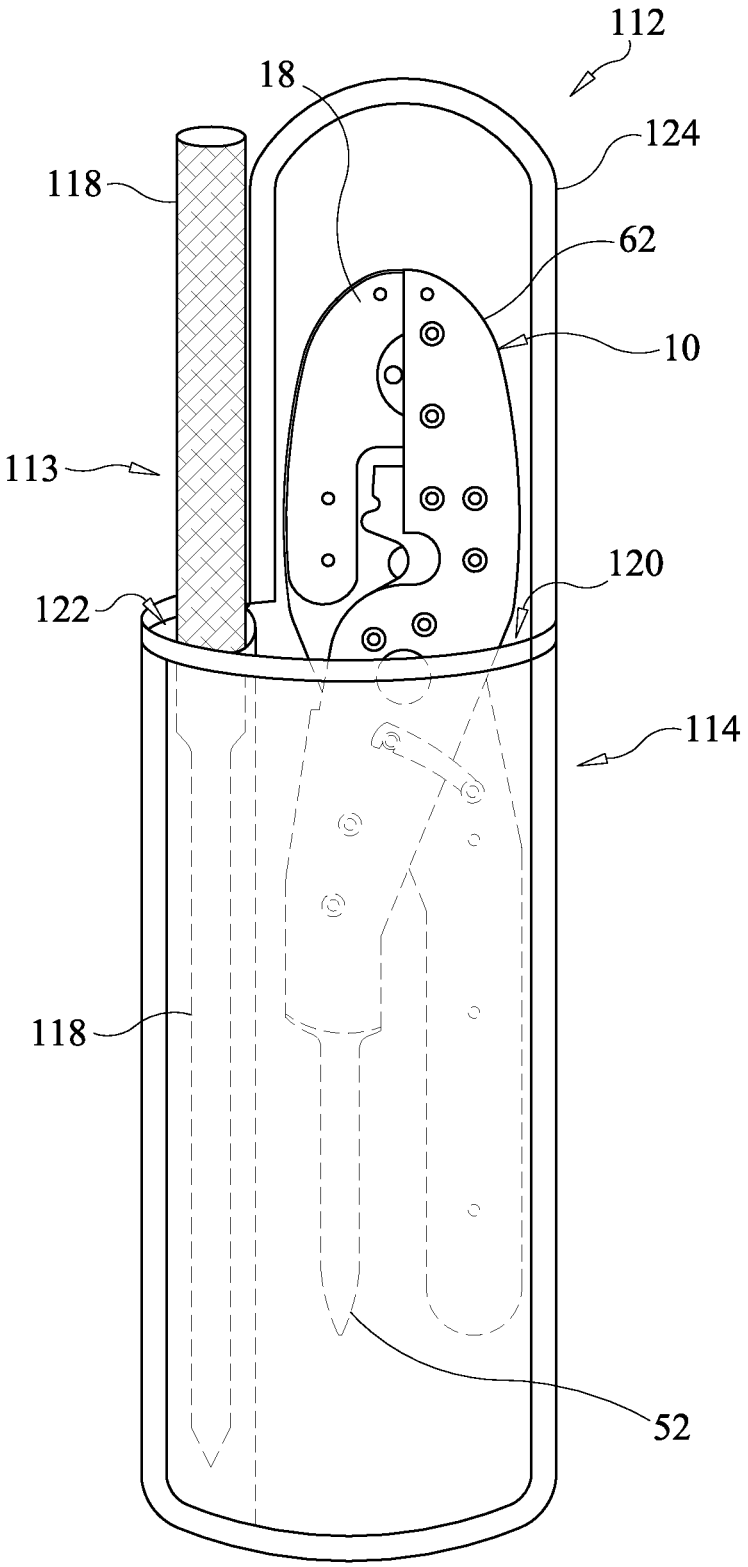
FIG. 6 is a perspective view of one embodiment of a system including the tool shown in FIG. 1, a priming probe and a holder for holding the tool and the priming probe.

In one embodiment, as shown in FIG. 6, a system 112 includes tool 10, similar to tool 10 described above with regard to FIGS. 1-5, a second powder punch or priming probe 113, and a holder 114 for holding tool 10 and priming probe 113. Priming probe 113 is larger than powder punch 52 both in diameter and length. Priming probe 113 extends between a first end, such as, for example, a handle portion 116, and a second end 118. Handle portion 116 includes a knurled exterior surface to enhance gripping of priming probe 113 by a user. In some embodiments, the exterior surface has various surface configurations, such as, for example, rough, threaded, arcuate, undulating, porous, semi-porous, dimpled, polished and/or textured to enhance gripping. Second end 118, similar to powder punch 52, includes a tapered distal tip configured for punching an opening in an explosive to receive a detonator or a piece of a detonating cord. Second end 118 or both handle portion 116 and second end 118 comprise G-10 high pressure glass laminate so as to prevent sparking and/or the generation of static electricity during use.

Holder 114 can be constructed from various materials, such as, for example, Cordoria, Kydex and/or leather. Holder 114 includes a first inner surface defining a first pouch 120 and a second inner surface defining a second pouch 122. First pouch 120 is dimensioned and configured for disposal of tool 10. Holder 114 includes a posterior extension, such as, for example, a backing 124 extending upwardly from first pouch 120 so as separate at least jaws 18, 62 from a user's body. Second pouch 122 is cylindrically shaped and configured for disposal of priming probe 113. Second pouch 122 is separated from first pouch 120 so as to prevent contact between priming probe 113 and tool 10 during non-use. In some embodiments, holder 114 includes a cover flap (not shown) that covers tool 10 and/or priming probe 113. It is contemplated that the cover flap is attached to holder 114 or is a separate component from holder 114. Holder 114 further includes a connector (not shown) configured for detachable engagement with a user's belt so as to connect the holder 114 to the user.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A multi-function hand tool, comprising:

a first member and a second member, the second member pivotally connected to the first member such that the hand tool is pivotable between an open orientation and a closed orientation;

the first member extending between a proximal end and a distal end, the distal end including a first cutting element and a second cutting element disposed proximal to the first cutting element, the first cutting element having a first cutting blade and the second cutting element having a second cutting blade and a first at least one groove;

the second member extending between a proximal end and a distal end, the distal end including a third cutting element corresponding to the second cutting element, the third cutting element having a third cutting blade corresponding to the second cutting blade and a second at least one groove corresponding to the first at least one groove, wherein in the closed orientation the first and second at least one grooves form at least one of a wire stripper and a crimper, wherein the first at least one groove includes a first pair of grooves and the second at least one groove includes a second pair of grooves, and in the closed orientation the first and second pairs of grooves forms the wire stripper and the crimper; and the proximal end of one of the first and second members including a longitudinal member having a tapered distal tip.

2. The tool as recited in claim 1, wherein the first, second and third cutting elements comprise a non-sparking, non-magnetic, non-conductive, non-static holding material having an anodized surface.

3. The tool as recited in claim 2, wherein the non-sparking, non-magnetic, non-conductive, non-static holding material is aluminum.

4. The tool as recited in claim 1, wherein the first pair of grooves includes a first semicircular groove and a first sinusoidal groove, and the second pair of grooves includes a second semicircular groove and a second sinusoidal groove, the first and second sinusoidal grooves forming the crimper in the closed orientation, and the first and second semicircular grooves forming the wire stripper in the closed orientation.

5. The tool as recited in claim 4, wherein the first and second semicircular grooves each include a beveled edge.

6. The tool as recited in claim 1, wherein the first cutting blade has a triangular profile.

7. The tool as recited in claim 1, further comprising an internal biasing member so as to resiliently bias the tool in the open orientation.

8. The tool as recited in claim 1, wherein the longitudinal member is a powder punch for punching an opening in an explosive.

9. The tool as recited in claim 8, wherein the powder punch comprises G-10 high pressure glass laminate.

10. The tool as recited in claim 1, further comprising a folding blade pivotally connected to the proximal end of one of the first and second members.

11. The tool as recited in claim 1, further comprising a locking mechanism to detachably lock the tool in the closed orientation.

12. The tool as recited in claim 11, wherein the locking mechanism includes a latch lock.

13. The tool as recited in claim 1, wherein the first and second members comprise G-10 high pressure composite glass laminate.

14. The tool as recited in claim 1, wherein the distal end of the second member includes a receptacle configured for disposal of the first cutting element in the closed orientation.

15. The tool as recited in claim 14, wherein the receptacle has an arcuate cross section configuration.

16. The tool as recited in claim 1, wherein the second and third cutting elements each include a projection configured for guiding a fuse or wire into the wire stripper and/or crimper.

17. A system, comprising:

the multi-function hand tool of claim 1;

a second tool; and a holder, the holder comprising a first pouch configured for disposal of the hand tool and a second pouch configured for disposal of the second tool.

18. A multi-function hand tool, comprising:

a first member and a second member, the second member pivotally connected to the first member such that the hand tool is pivotable between an open orientation and a closed orientation;

the first member extending between a first handle portion and a first jaw, the first jaw including a first cutting element and a second cutting element disposed proximal to the first cutting element, the first cutting element having a first cutting blade and the second cutting element having a second cutting blade, a first semicircular groove and a first sinusoidal groove, the first sinusoidal groove being proximal to the first semicircular groove;

the second member extending between a second handle portion and a second jaw, the second jaw including a third cutting element corresponding to the second cutting element, the third cutting element having a third cutting blade corresponding to the second cutting blade, a second semicircular groove corresponding to the first semicircular groove and a second sinusoidal groove corresponding to the first sinusoidal groove, the first and second semicircular grooves each including a beveled edge, wherein in the closed orientation the first and second semicircular grooves form a wire stripper and the first and second sinusoidal grooves form a crimper; and the handle portion of one of the first and second members includes a powder punch.

19. The tool as recited in claim 18, wherein the first, second and third cutting elements comprise aluminum having an anodized surface and the powder punch comprises G-10 high pressure glass laminate.

20. A multi-function hand tool, comprising:

a first member and a second member, the second member pivotally connected to the first member such that the hand tool is pivotable between an open orientation and a closed orientation;

the first member extending between a proximal end and a distal end, the distal end including a first cutting element and a second cutting element disposed proximal to the first cutting element, the first cutting element having a first cutting blade with a triangular profile and the second cutting element having a second cutting blade and a first at least one groove;

the second member extending between a proximal end and a distal end, the distal end including a third cutting element corresponding to the second cutting element, the third cutting element having a third cutting blade corresponding to the second cutting blade and a second at least one groove corresponding to the first at least one groove, wherein in the closed orientation the first and second at least one grooves form at least one of a wire stripper and a crimper; and the proximal end of one of the first and second members including a longitudinal member having a tapered distal tip.

* * * * *